US009301595B2

(12) United States Patent
Tedder

(10) Patent No.: US 9,301,595 B2
(45) Date of Patent: Apr. 5, 2016

(54) MULTI-LAYERED HOLSTER TO SECURE AN INSTRUMENT

(71) Applicant: Old Faithful Holsters, Coeur d'Alene, ID (US)

(72) Inventor: Thomas Tedder, Coeur d'Alene, ID (US)

( * ) Notice: Subject to any disclaimer, the term of this patent is extended or adjusted under 35 U.S.C. 154(b) by 160 days.

(21) Appl. No.: 14/219,071

(22) Filed: Mar. 19, 2014

(65) Prior Publication Data

US 2015/0267994 A1 Sep. 24, 2015

(51) Int. Cl.

| | |
|---|---|
| ***F41C 33/02*** | (2006.01) |
| ***A45F 5/00*** | (2006.01) |
| *F41C 33/04* | (2006.01) |

(52) U.S. Cl.

CPC ..... *A45F 5/00* (2013.01); *F41C 33/0227* (2013.01); *A45F 2200/0591* (2013.01); *F41C 33/0209* (2013.01); *F41C 33/048* (2013.01); *Y10S 224/911* (2013.01); *Y10S 224/912* (2013.01)

(58) Field of Classification Search

CPC .. F41C 33/02; F41C 33/0209; F41C 33/0236; F41C 33/048; Y10S 224/911; Y10S 224/912; A45F 2200/0591

USPC ..... 224/192, 193, 587, 198, 238, 243, 244, 224/911, 912

See application file for complete search history.

(56) References Cited

U.S. PATENT DOCUMENTS

| | | | | | |
|---|---|---|---|---|---|
| 4,062,481 | A * | 12/1977 | Clark | F41C 33/0236 | 224/243 |
| 4,759,482 | A * | 7/1988 | Olsen | F41C 33/0227 | 224/238 |
| 5,622,295 | A * | 4/1997 | Hellweg | F41C 33/0236 | 224/193 |
| 6,092,703 | A * | 7/2000 | Johnson | F41C 33/0209 | 224/198 |
| 6,547,111 | B2 * | 4/2003 | French | F41C 33/0227 | 224/244 |
| 2002/0162865 | A1 * | 11/2002 | Beletsky | F41C 33/0227 | 224/193 |
| 2010/0270349 | A1 * | 10/2010 | Craighead | F41C 33/041 | 224/587 |
| 2014/0158733 | A1 * | 6/2014 | McDonnell | F41C 33/048 | 224/587 |
| 2015/0034683 | A1 * | 2/2015 | Tedder | A45F 5/00 | 224/242 |
| 2015/0034684 | A1 * | 2/2015 | Tedder | A45F 5/00 | 224/242 |
| 2015/0115005 | A1 * | 4/2015 | Slinkard | F41C 33/043 | 224/243 |

* cited by examiner

*Primary Examiner* — Justin Larson
(74) *Attorney, Agent, or Firm* — Timberline Patent Law Group

(57) ABSTRACT

A device holster may accommodate different sized devices, such as guns, weapons, tools, etc. One example configuration may include a front cover that includes a number of engaging snap portions and a molded surface area that provides a cavity shaped as a hand gun barrel and hand gun trigger housing, and a rear cover with a larger surface area than the front cover which provides a rear cover including a number of layers including a first layer composed of a first material, a middle layer composed of a second material and a third layer composed of a third material, and the second material of the middle layer is different from the first material of the first layer.

20 Claims, 2 Drawing Sheets

200

MULTI-LAYERED HOLSTER TO SECURE AN INSTRUMENT

CROSS-REFERENCE TO RELATED APPLICATIONS

This application relates to U.S. patent application Ser. No. 13/959,300, filed on Aug. 5, 2013, entitled ADJUSTABLE HOLSTER TO SECURE AN INSTRUMENT, and U.S. patent application Ser. No. 13/959,349, filed on Aug. 5, 2013, entitled ADJUSTABLE HOLSTER TO SECURE AN INSTRUMENT, the entire contents of which are hereby incorporated by reference.

TECHNICAL FIELD OF THE APPLICATION

This application relates to a holster for securing a firearm or other object to a user's body, and more particularly, to a multi-layered holster that secures instruments and/or firearms.

BACKGROUND OF THE APPLICATION

Conventionally, holsters worn by users of such instruments (i.e., weapons, guns, tools, etc.) are large, bulky and not comfortable for a user desiring to keep the instruments close to or against his or her body. Depending on the type of instrument, the instrument dimensions can be sharp, hard, pointy and/or awkward for a user to keep strapped against his or her body. The materials used to secure the instrument also need to be generally thin and smooth to ensure comfort for the user. Also, the materials most commonly associated with a holster are smooth plastics or poly-synthetic materials and/or leather which are aesthetically pleasing to a user by comfort and appearance. However, by having multiple layers it may be possible to ensure a comfortable experience for the user while maintaining a professional appearance and holstering capability.

SUMMARY OF THE APPLICATION

One embodiment of the present application may include an apparatus that includes a front cover with a plurality of engaging snap portions and a molded surface area that provides a cavity for instrument insertion, and a rear cover with a plurality of layers including a first layer composed of a first material, a middle layer composed of a second material and a third layer composed of a third material, wherein the second material of the middle layer is different from the first material of the first layer, and a plurality of receiving snap portions configured to engage the plurality of engaging snap portions.

Another example embodiment includes an apparatus with a front cover having a molded surface area that provides a cavity shaped as a hand gun barrel and a hand gun trigger housing, and a rear cover including a plurality of layers including a first layer composed of a first material, a middle layer composed of a second material and a third layer composed of a third material, wherein the second material of the middle layer is different from the first material of the first layer.

DETAILED DESCRIPTION OF THE APPLICATION

It will be readily understood that the components of the present application, as generally described and illustrated in the figures herein, may be arranged and designed in a wide variety of different configurations. Thus, the following detailed description of the embodiments of an apparatus, and system configuration, as represented in the attached figures, is not intended to limit the scope of the application as claimed, but is merely representative of selected embodiments of the application.

The features, structures, or characteristics of the application described throughout this specification may be combined in any suitable manner in one or more embodiments. For example, the usage of the phrases "example embodiments", "some embodiments", or other similar language, throughout this specification refers to the fact that a particular feature, structure, or characteristic described in connection with the embodiment may be included in at least one embodiment of the present application. Thus, appearances of the phrases "example embodiments", "in some embodiments", "in other embodiments", or other similar language, throughout this specification do not necessarily all refer to the same group of embodiments, and the described features, structures, or characteristics may be combined in any suitable manner in one or more embodiments.

Figure 1:
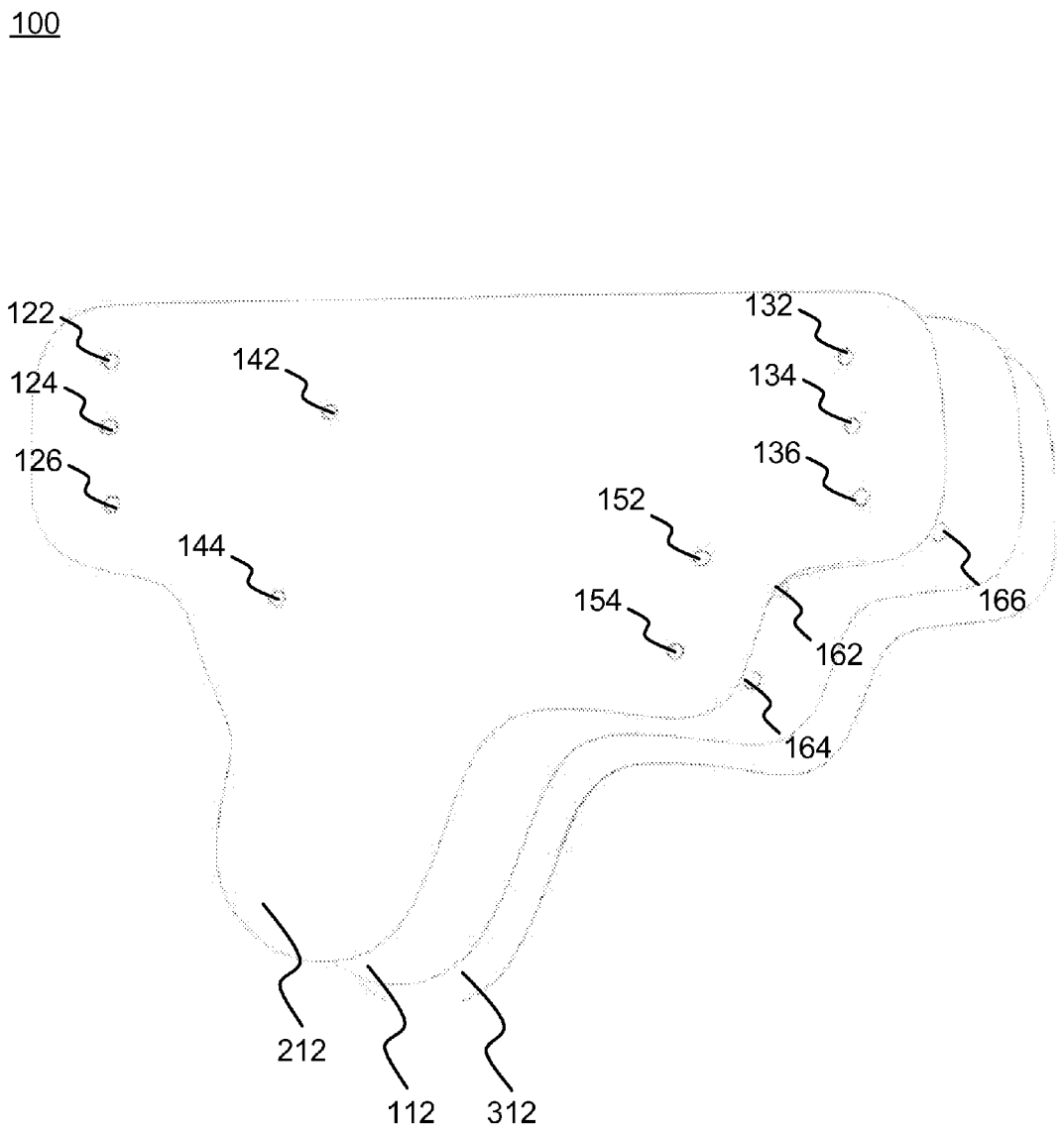
FIG. 1 illustrates an example exploded view of a three-layered rear cover holster portion according to example embodiments.

FIG. 1 illustrates an example exploded view 100 of a rear holster cover portion according to example embodiments. Referring to FIG. 1, the exploded view includes three layers of rear holster material each of which is significantly similar to the other. For example, the rearmost rear layer, or 'rear layer' 312 may be approximately the same size as the middle rear layer or 'middle layer' 112 and the front rear layer 212. However, it is important to note that in certain example embodiments, the middle layer 112 may be slightly smaller than both the rearmost rear layer 312 and the front rear layer 212 which permits the middle layer 112 to be completely hidden from view when the front layer 212 and the rearmost rear layer 312 are firmly secure to one another via a securing bolt, nut or combination of both. Also, in the configuration of FIG. 1 the rear cover holster layers are upside-down from where the user would insert the instrument (see FIG. 2 for a proper orientation).

The middle layer 112 may be smaller by about approximately 1/32, 1/16, 1/8 or 1/4 of an inch all around the perimeter of the middle layer 112 as compared to the larger front layer 212 and/or the rear layer 312. In this example configuration, the middle layer 112 can be hidden from view when the front and rear layers are secured together. According to example embodiments the material compositions of each of the three layers may be the same, different or two layers may be the same while one of the other three layers is different. For example, in one example embodiment the front layer and the rear layer are leather and the middle layer is a softer polysynthetic material that provides a cushion with a particular firmness coefficient that is suitable for a user who may desire comfort when a bulky and large hand gun is resting inside the holster (i.e., between a front cover and the rear holster layers).

In one example embodiment, the front layer 212 is made of a vinyl material or a leather animal hide type of material, the middle layer 112 is made of plastic, ABS, KYDEX, or comparable material and the rear layer 312 is made of NEOPRENE which is cheaper than leather and relatively comfortable against a body of a person. Also, in this example the front layer 212 is about 1-2 mm thick, the middle layer 112 is about 1-2 mm thick and may be slightly thinner than the front layer and the rear layer is about 2-6 mm of NEOPRENE. The four holes in the middle 142, 144, 152, 154 and corresponding holes 162, 164 and other holes not visible are for a plastic holster shell as may be observed from FIG. 2. The other holes 122-136 are for the belt loop configuration.

In another example, the middle layer 112 may be leather similar to the front and rear layers 212 and 312, however, the middle layer 112 may have a thicker cross-sectional depth area than the front layer 212 and the rear layer 312. Or, the middle layer 112 may be the same thickness as the front and rear layers 212 and 312 and may be the same material. Alternatively, the middle layer 112 may have a smaller cross-sectional depth area than the front layer 212 and the rear layer 312, but may still be made of the same type of material. Yet in another example, the middle layer may be made from a different material from the front layer and the rear layer. In yet another example, the middle layer may be made from the same material as one of the front layer and the rear layer but not both the front layer and the rear layer, as one of the exterior layers may be made of a different material than the other two layers. Examples of different materials used for the various different rear layers may include leather, neoprene, plastic, vinyl, wood, metal, etc.

In another example embodiment, the middle layer 112 is made of a plastic material having a relatively firm and rigid construction. This configuration may provide a middle layer 112 with a relatively thin cross-sectional depth while providing a hard plastic protective shell so the gun inside the holster will not be as likely to press against the user's skin and cause irritation. In this configuration, the middle layer may have a depth of only about 1/64, 1/32 or 1/16 of an inch and may be rigid and generally difficult to bend by the user, although not perfectly rigid as the user may feel pressure against his or her body if the material is overly-rigid. In this example, since the middle layer is supposed to be relatively thin, the outer layers may be thicker and softer to encase the middle layer on both sides without the middle layer being visible. Also, the middle layer may have a natural curve present that would correspond to a user's leg or hip protruding towards the three-layer configuration while preserving a relatively arcuate position to correspond with the user's body. The arcuate structure may have an arc angle of anywhere between 10 and 120 degrees to correspond to the user's body.

Figure 2:
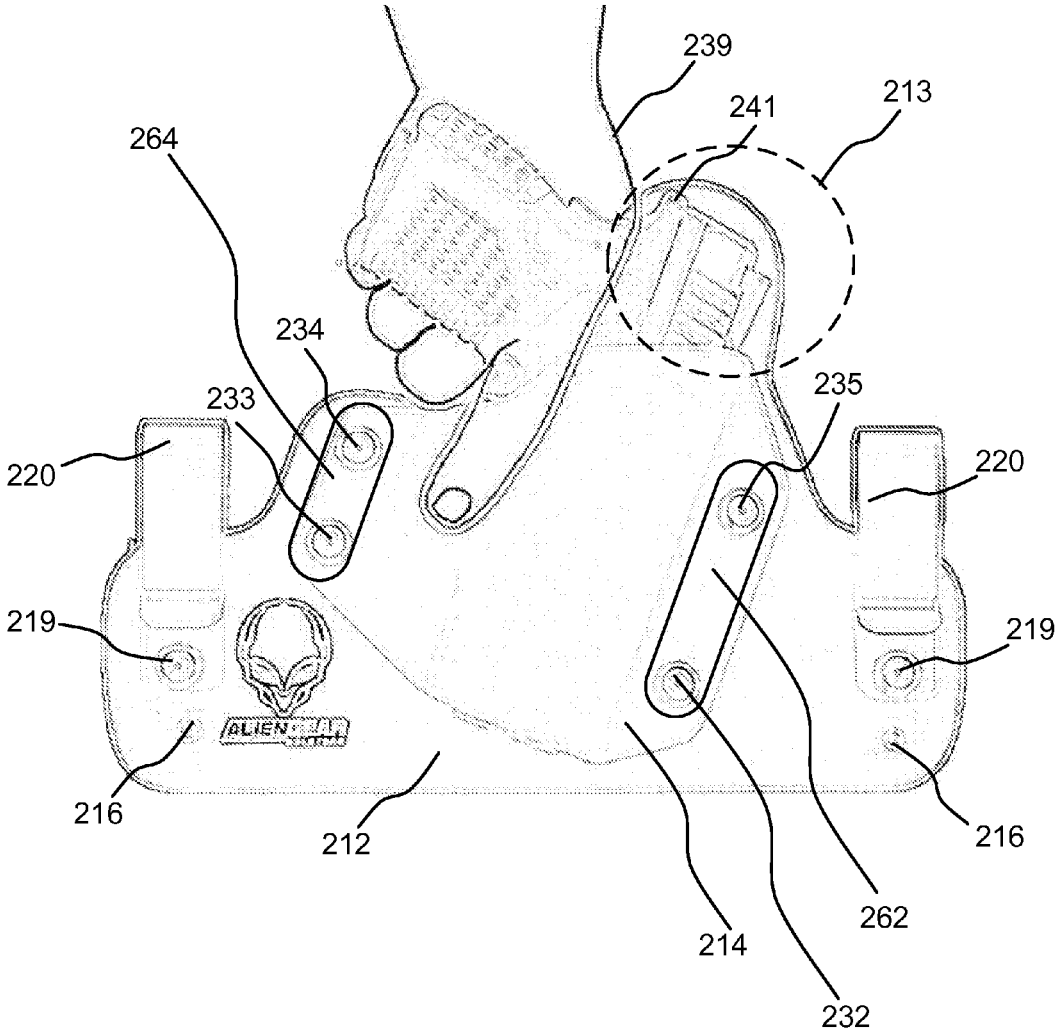
FIG. 2 illustrates an example front view of the holster configuration according to example embodiments.

In FIG. 1, the three layers 212, 112 and 312 are configured to be one on top of the next layer with 10 holes per layer. The outer most holes 122, 124, 126, 132, 134 and 136 are aligned to corresponding with snap inserts, belt loops and other mechanisms for affixing the holster to the user's clothing or accessories. The interior surface holes 142, 144, 152 and 154 correspond with a set of snaps that may be inserted to hold the front cover of the holster 214 (see FIG. 2) against the rear portion of the holster 212 which is shown to be the first or front layer 212 as depicted in FIGS. 1 and 2. The additional holes 162 and 164 may be in the middle layer 112 and may correspond to the holes 152 and 154 in the first layer so a snap insert may be inserted into the matching holes of each layer. Similarly, hole 166 in the middle layer 112 may correspond to the hole 136 in the front layer 212. Also, the middle layer 112 may provide structural support to maintain the proper cavity structure for instrument insertion in the event that the holster is not in use or is weighted down in storage by another object.

FIG. 2 illustrates an example front view of a holster according to example embodiments. Referring to FIG. 2, the holster configuration 200 includes a plurality of top snap portions 232-235 and a corresponding plurality of receiving snap portions hidden behind the top snap cover. Other portions of the holster include a set of receiving snaps (not shown) that are affixed to the rear holster portion via the front layer 212 to receive a belt clip 220 or other belt fastening peripheral that may be snapped into a position near the top of the rear holster portion (front layer) 212 to provide a loop for a belt to be inserted to support the holster 200 against the body of a person. Instead of snaps, the holes may provide a passage for screws both permanent and removable to bind the holster layers and cover portions together. The top portion of the rear holster portion 212 may have an elongated tab 213 at a substantially center portion of the top edge of the rear holster portion 212 that extends beyond the generally straight surface of the top edge of the rear holster portion 212. The elongated tab 213 at the top portion of the holster. A main surface area of the back cover 212 may be a substantially rectangular portion of the back cover excluding the elongated tab 213. A main surface area of the front cover 214 may be a substantially rectangular surface area that includes the various snap portions, but which excludes a barrel formed protrusion in the middle of the front cover (not shown) and a trigger housing protrusion portion which extends beyond the main portion of the front cover 214.

According to one example embodiment, the rear holster portion 212 is significantly larger in area than the area of the front cover or front holster portion 214. For example, the rear holster portion 212 may be approximately 100% to 400% larger in surface area than the planar surface area of the front cover portion 214. The front cover portion 214 may also be made of a different material than the rear portion 212. The front cover 214 may have multiple molded protrusions that extends beyond the surface area of the main cover portion 214. For example, the barrel portion may be one molded protrusion and the trigger and/or trigger housing portion may be another molded protrusion extending beyond the planar surface area of the front cover 214. This configuration permits the gun 241 to be inserted into a voluminous area (as shown by the user hand 239) defined by the protrusions which protrude away from the flat planar surface of the main area of the front cover 214. Also, the molded protrusion may extend beyond a main surface area of the front cover 214 by approximately 1-2 inches to cover the voluminous channel consumed by a gun barrel placed in the holster.

In one example embodiment, the front cover portion 214 may be made of a form-fitted plastic that is specifically designed to accommodate a particular caliber or gauge size of a handheld gun. In this example, the snaps may be positioned in the same general locations on different front cover portions that are wider, deeper, longer, etc. This configuration provides a common snap receiving array as indicated by the snap portions that may be used for differently sized front covers which engage the receiving snap portions with engaging snap portions 232, 233, 234 and 235 which are paired by an engaging snap connector piece 262 and 264. The connector pieces are of varying lengths and provide a securing mechanism to avoid pressure from the heavy gun pressing against the snaps individually. Top snaps 216 may be part of a belt snap configuration worn by the user to offer additional securing restraints. The belt loop snaps 219 offer a convenient way to remove the belt loops if necessary.

In one example, a holster for an instrument tool or gun may include a front cover with a plurality of engaging snap portions and a molded surface area that provides a cavity for instrument insertion, and a rear cover including a plurality of layers including a first layer composed of a first material, a middle layer composed of a second material and a third layer composed of a third material, wherein the second material of the middle layer is different from the first material of the first layer, and a plurality of receiving snap portions configured to engage the plurality of engaging snap portions.

The front cover could be a different material than the first layer of the rear cover and may be a plastic where the other layers are an animal hide leather. The plastic may be form-fitted and rigid plastic or form-fitted and flexible. The first layer and the second layer of the rear cover are animal hide leather and the middle layer is plastic. The middle layer may have a same depth, a larger depth or a thinner depth than the first layer and the second layer. The middle layer may have a larger rigidity coefficient than a rigidity coefficient of first layer and a rigidity coefficient of the second layer to maintain a larger degree of protection from friction caused by the movement of the gun in the holster. Also, each of the three layers includes a same number of holes which match a corresponding position on each of the three layers. The surface area of the middle layer may be less than the surface area of the first layer and the surface area of the second layer.

Another example embodiment may provide a holster with front cover that includes a molded surface area that provides a cavity shaped as a hand gun barrel and a hand gun trigger housing, and a rear cover with a plurality of layers including a first layer composed of a first material, a middle layer composed of a second material and a third layer composed of a third material, and the second material of the middle layer is different from the first material of the first layer.

It will be readily understood that the components of the application, as generally described and illustrated in the figures herein, may be arranged and designed in a wide variety of different configurations. Thus, the detailed description of the embodiments is not intended to limit the scope of the application as claimed, but is merely representative of selected embodiments of the application.

Therefore, although the application has been described based upon these preferred embodiments, it would be apparent to those of skill in the art that certain modifications, variations, and alternative constructions would be apparent, while remaining within the spirit and scope of the application. In order to determine the metes and bounds of the application, therefore, reference should be made to the appended claims.

What is claimed is:

1. An apparatus comprising:

a removable front cover comprising a plurality of engaging snap portions and a molded plastic shell that provides a form-fitted cavity for insertion of a particular handheld gun; and a rear cover comprising a plurality of layers including a first layer composed of a synthetic material, a middle layer composed of a metal material and a second layer composed of a neoprene material, wherein the neoprene material of the second layer is different from the synthetic material of the first layer, and a plurality of receiving snap portions configured to engage the plurality of engaging snap portions.

2. The apparatus of claim 1, wherein the front cover is a different material than the first layer of the rear cover.

3. The apparatus of claim 2, wherein the front cover material is a plastic.

4. The apparatus of claim 3, wherein the plastic is form-fitted and rigid.

5. The apparatus of claim 3, wherein the plastic is form-fitted and flexible.

6. The apparatus of claim 1, wherein the middle layer of the rear cover includes an arcuate shape to correspond to a user's hip or leg.

7. The apparatus of claim 1, wherein the middle layer has a thinner depth than the first layer and the second layer.

8. The apparatus of claim 1, wherein the middle layer has a larger rigidity coefficient than a rigidity coefficient of first layer and a rigidity coefficient of the second layer.

9. The apparatus of claim 1, wherein each of the three layers comprises a same number of a plurality of holes which match a corresponding position on each of the three layers.

10. The apparatus of claim 1, wherein the surface area of the middle layer is less than the surface area of the first layer and the surface area of the second layer.

11. An apparatus comprising:

a removable front cover comprising a molded plastic shell that provides a form-fitted cavity shaped as a particular hand gun barrel and trigger housing; and a substantially planar rear cover comprising a plurality of layers including a first layer composed of a first material, a middle layer composed of a second material and a second layer composed of a third material, wherein the first material of the first layer, the second material of the middle layer, and the third material of the second layer are different materials, and wherein the second material of the middle layer comprises a metal.

12. The apparatus of claim 11, wherein the front cover is a different material than the first layer of the rear cover.

13. The apparatus of claim 12, wherein the front cover material is a plastic and at least one of the three rear cover layers comprises an animal hide leather.

14. The apparatus of claim 13, wherein the plastic is form-fitted and rigid.

15. The apparatus of claim 13, wherein the plastic is form-fitted and flexible.

16. The apparatus of claim 11, wherein the first layer and the second layer of the rear cover are animal hide leather.

17. The apparatus of claim 16, wherein the middle layer has a thinner cross-sectional depth than the first layer and the second layer.

18. The apparatus of claim 16, wherein the middle layer has a larger rigidity coefficient than a rigidity coefficient of first layer and a rigidity coefficient of the second layer.

19. The apparatus of claim 11, wherein each of the three layers comprises a same number of a plurality of holes which match a corresponding position on each of the three layers.

20. The apparatus of claim 11, wherein the surface area of the middle layer is less than the surface area of the first layer and the surface area of the second layer.

* * * * *